US008027833B2

(12) United States Patent
Hetherington et al.

(10) Patent No.: US 8,027,833 B2
(45) Date of Patent: Sep. 27, 2011

(54) SYSTEM FOR SUPPRESSING PASSING TIRE HISS

(75) Inventors: Phillip A. Hetherington, Port Moody (CA); Shreyas A. Paranjpe, Vancouver (CA)

(73) Assignee: QNX Software Systems Co., Ottawa, Ontario (CA)

( * ) Notice: Subject to any disclaimer, the term of this patent is extended or adjusted under 35 U.S.C. 154(b) by 1905 days.

(21) Appl. No.: 11/125,052

(22) Filed: May 9, 2005

(65) Prior Publication Data

US 2006/0251268 A1 Nov. 9, 2006

(51) Int. Cl.
*G10L 21/02* (2006.01)

(52) U.S. Cl. ..... 704/226

(58) Field of Classification Search ..... 704/227
See application file for complete search history.

(56) References Cited

U.S. PATENT DOCUMENTS

| | | | | |
|---|---|---|---|---|
| 4,486,900 | A | 12/1984 | Cox et al. | |
| 4,531,228 | A | 7/1985 | Noso et al. | |
| 4,630,305 | A | 12/1986 | Borth et al. | |
| 4,811,404 | A | 3/1989 | Vilmur et al. | |
| 4,843,562 | A | 6/1989 | Kenyon et al. | |
| 5,027,410 | A | 6/1991 | Williamson et al. | |
| 5,056,150 | A | 10/1991 | Yu et al. | |
| 5,146,539 | A | 9/1992 | Doddington et al. | |
| 5,313,555 | A | 5/1994 | Kamiya | |
| 5,355,717 | A * | 10/1994 | Tanaka et al. | 73/105 |
| 5,400,409 | A | 3/1995 | Linhard | |
| 5,479,517 | A | 12/1995 | Linhard | |
| 5,495,415 | A | 2/1996 | Ribbens et al. | |
| 5,502,688 | A | 3/1996 | Recchione et al. | |
| 5,526,466 | A | 6/1996 | Takizawa | |
| 5,568,559 | A | 10/1996 | Makino | |
| 5,584,295 | A | 12/1996 | Muller et al. | |
| 5,596,141 | A * | 1/1997 | Nishikawa et al. | 73/146.2 |
| 5,617,508 | A | 4/1997 | Reaves | |
| 5,677,987 | A | 10/1997 | Seki et al. | |
| 5,680,508 | A | 10/1997 | Liu | |
| 5,692,104 | A | 11/1997 | Chow et al. | |
| 5,701,344 | A | 12/1997 | Wakui | |
| 5,933,801 | A | 8/1999 | Fink et al. | |
| 5,937,070 | A * | 8/1999 | Todter et al. | 381/71.6 |
| 5,949,888 | A | 9/1999 | Gupta et al. | |
| 6,011,853 | A | 1/2000 | Koski et al. | |
| 6,163,608 | A | 12/2000 | Romesburg et al. | |

(Continued)

FOREIGN PATENT DOCUMENTS

CA 2158847 9/1994

(Continued)

OTHER PUBLICATIONS

Vaseghi "Advanced Digital Signal Processing and Noise Reduction", John Wiley and Sons, Second Edition, 2000.*

(Continued)

*Primary Examiner* — Jakieda R Jackson
(74) *Attorney, Agent, or Firm* — Brinks Hofer Gilson & Lione

(57) ABSTRACT

A voice enhancement logic improves the perceptual quality of a processed voice. The voice enhancement system includes a passing tire hiss noise detector and a passing tire hiss noise attenuator. The passing tire hiss noise detector detects a passing tire hiss noise by modeling the passing tire hiss. The passing tire hiss noise attenuator dampens the passing tire hiss noise to improve the intelligibility of a speech signal.

60 Claims, 12 Drawing Sheets

U.S. PATENT DOCUMENTS

| | | | | |
|---|---|---|---|---|
| 6,167,375 | A | 12/2000 | Miseki et al. | |
| 6,173,074 | B1 | 1/2001 | Russo | |
| 6,175,602 | B1 | 1/2001 | Gustafsson et al. | |
| 6,192,134 | B1 | 2/2001 | White et al. | |
| 6,199,035 | B1 | 3/2001 | Lakaniemi et al. | |
| 6,208,268 | B1 * | 3/2001 | Scarzello et al. | 340/941 |
| 6,405,168 | B1 | 6/2002 | Bayya et al. | |
| 6,434,246 | B1 | 8/2002 | Kates et al. | |
| 6,507,814 | B1 | 1/2003 | Gao | |
| 6,587,816 | B1 | 7/2003 | Chazan et al. | |
| 6,643,619 | B1 | 11/2003 | Linhard et al. | |
| 6,687,669 | B1 | 2/2004 | Schrögmeier et al. | |
| 6,782,363 | B2 | 8/2004 | Lee et al. | |
| 6,822,507 | B2 | 11/2004 | Buchele | |
| 6,859,420 | B1 | 2/2005 | Coney et al. | |
| 6,910,011 | B1 | 6/2005 | Zakarauskas | |
| 7,117,149 | B1 | 10/2006 | Zakarauskas | |
| 2001/0028713 | A1 | 10/2001 | Walker | |
| 2002/0071573 | A1 | 6/2002 | Finn | |
| 2002/0176589 | A1 | 11/2002 | Buck et al. | |
| 2002/0178823 | A1 * | 12/2002 | Inoue | 73/702 |
| 2003/0040908 | A1 | 2/2003 | Yang et al. | |
| 2003/0216907 | A1 | 11/2003 | Thomas | |
| 2004/0078200 | A1 | 4/2004 | Alves | |
| 2004/0138882 | A1 | 7/2004 | Miyazawa | |
| 2004/0165736 | A1 | 8/2004 | Hetherington et al. | |
| 2004/0167777 | A1 | 8/2004 | Hetherington et al. | |
| 2004/0239323 | A1 * | 12/2004 | Taylor et al. | 324/307 |
| 2005/0114128 | A1 | 5/2005 | Hetherington et al. | |
| 2005/0161138 | A1 * | 7/2005 | Yukawa et al. | 152/450 |
| 2005/0240401 | A1 | 10/2005 | Ebenezer | |
| 2006/0034447 | A1 | 2/2006 | Alves et al. | |
| 2006/0074646 | A1 | 4/2006 | Alves et al. | |
| 2006/0100868 | A1 | 5/2006 | Hetherington et al. | |
| 2006/0115095 | A1 | 6/2006 | Glesbrecht et al. | |
| 2006/0116873 | A1 | 6/2006 | Hetherington et al. | |
| 2006/0136199 | A1 | 6/2006 | Nongpiur et al. | |
| 2006/0287859 | A1 | 12/2006 | Hetherington et al. | |
| 2007/0025814 | A1 * | 2/2007 | Woodruff | 404/15 |
| 2007/0033031 | A1 | 2/2007 | Zakarauskas | |

FOREIGN PATENT DOCUMENTS

| | | | |
|---|---|---|---|
| CA | 2157496 | | 10/1994 |
| CA | 2158064 | | 10/1994 |
| EP | 0 076 687 | A1 | 4/1983 |
| EP | 0 629 996 | A2 | 12/1994 |
| EP | 0 629 996 | A3 | 12/1994 |
| EP | 0 750 291 | A1 | 12/1996 |
| EP | 1 450 353 | A1 | 8/2004 |
| EP | 1 450 354 | A1 | 8/2004 |
| EP | 1 669 983 | A1 | 6/2006 |
| JP | 06269084 | A2 | 9/1994 |
| JP | 06319193 | A | 11/1994 |
| WO | WO 00-41169 | A1 | 7/2000 |
| WO | WO 01-56255 | A1 | 8/2001 |
| WO | WO 01-73761 | A1 | 10/2001 |

OTHER PUBLICATIONS

Keijiro Iwao, A study on the mechanism of tire/road noise, Sep. 25, 1995, Vehicle Research Laboratory, 139-144.*

Avendano, C., Hermansky, H., "Study on the Dereverberation of Speech Based on Temporal Envelope Filtering," Proc. ICSLP '96, pp. 889-892, Oct. 1996.

Berk et al., "Data Analysis with Microsoft Excel", Duxbury Press, 1998, pp. 236-239 and 256-259.

Fiori, S., Uncini, A., and Piazza, F., "Blind Deconvolution by Modified Bussgang Algorithm", Dept. of Electronics and Automatics—University of Ancona (Italy), ISCAS 1999.

Learned, R.E. et al., A Wavelet Packet Approach to Transient Signal Classification, Applied and Computational Harmonic Analysis, Jul. 1995, pp, 265-278, vol. 2, No. 3, USA, XP 000972660. ISSN: 1063-5203. abstract.

Nakatani, T., Miyoshi, M., and Kinoshita, K., "Implementation and Effects of Single Channel Dereverberation Based on the Harmonic Structure of Speech," Proc. of IWAENC-2003, pp. 91-94, Sep. 2003.

Puder, H. et al., "Improved Noise Reduction for Hands-Free Car Phones Utilizing Information on a Vehicle and Engine Speeds", Sep. 4-8, 2000, pp. 1851-1854, vol. 3, XP009030255, 2000. Tampere, Finland, Tampere Univ. Technology, Finland Abstract.

Quatieri, T.F. et al., Noise Reduction Using a Soft-Dection/Decision Sine-Wave Vector Quantizer, International Conference on Acoustics, Speech & Signal Processing, Apr. 3, 1990, pp. 821-824, vol. Conf. 15, IEEE ICASSP, New York, US XP000146895, Abstract, Paragraph 3.1.

Quelavoine, R. et al., Transients Recognition in Underwater Acoustic with Multilayer Neural Networks, Engineering Benefits from Neural Networks, Proceedings of the International Conference EANN 1998, Gibraltar, Jun. 10-12, 1998 pp. 330-333, XP 000974500. 1998, Turku, Finland, Syst. Eng. Assoc., Finland. ISBN: 951-97868-0-5. abstract, p. 30 paragraph 1.

Seely, S., "An Introduction to Engineering Systems", Pergamon Press Inc., 1972, pp. 7-10.

Shust, Michael R. and Rogers, James C., Abstract of "Active Removal of Wind Noise From Outdoor Microphones Using Local Velocity Measurements", *J. Acoust. Soc. Am.*, vol. 104, No. 3, Pt 2, 1998, 1 page.

Shust, Michael R. and Rogers, James C., "Electronic Removal of Outdoor Microphone Wind Noise", obtained from the Internet on Oct. 5, 2006 at: <http://www.acoustics.org/press/136th/mshust.htm>, 6 pages.

Simon, G., Detection of Harmonic Burst Signals, International Journal Circuit Theory and Applications, Jul. 1985, vol. 13, No. 3, pp. 195-201, UK, XP 000974305. ISSN: 0098-9886. abstract.

Vieira, J., "Automatic Estimation of Reverberation Time", Audio Engineering Society, Convention Paper 6107, 116th Convention, May 8-11, 2004, Berlin, Germany, pp. 1-7.

Wahab A. et al., "Intelligent Dashboard With Speech Enhancement", Information, Communications, and Signal Processing, 1997. ICICS, Proceedings of 1997 International Conference on Singapore, Sep. 9-12, 1997, New York, NY, USA, IEEE, pp. 993-997.

Zakarauskas, P., Detection and Localization of Nondeterministic Transients in Time series and Application to Ice-Cracking Sound, Digital Signal Processing, 1993, vol. 3, No. 1, pp. 36-45, Academic Press, Orlando, FL, USA, XP 000361270, ISSN: 1051-2004. entire document.

* cited by examiner

SYSTEM FOR SUPPRESSING PASSING TIRE HISS

BACKGROUND OF THE INVENTION

1. Technical Field

This invention relates to acoustics, and more particularly, to a system that enhances the perceptual quality of a processed voice.

2. Related Art

Many communication devices acquire, assimilate, and transfer a voice signal. Voice signals pass from one system to another through a communication medium. In some systems, including some systems used in vehicles, the clarity of the voice signal does not depend only on the quality of the communication system or the quality of the communication medium. The clarity of the voice signal may also depend on the amount of noise which accompanies the voice signal. When noise occurs near a source or a receiver, distortion garbles the voice signal, destroys information, and in some instances, masks the voice signal so that it is not recognized by a listener or a voice recognition system.

Noise, which may be annoying, distracting, or result in a loss of information, may come from many sources. Noise from a vehicle may be created by the engine, the road, the tires, or by the movement of air. When a vehicle is in motion on a paved road, a significant amount of the noise it produces may be generated from the contact between the tire and the road—a whooshing or hissing sound one hears as the car passes by. This sound may be particularly noticeable to others driving on the highway with their windows down. The noise may originate from an air pumping effect emanating from the air compression and expansion between the tires of the passing car and the road. This sound may be amplified by the side less horn shape formed by the tire and the road. The short-term, or transient, whooshing or hissing sound as a vehicle passes by a communication device may cause the communication device to suffer voice quality and intelligibility loss, and may also cause speech recognition failure.

Noise estimation techniques may have temporal smoothing parameters to ensure that they do not incorporate speech and temporally short events into their estimates. Because passing tire hiss noise may have a duration similar to that of speech sounds, many conventional noise estimation techniques are unsuitable for identifying passing tire hiss as noise. Instead, passing tire hiss noise may be misinterpreted as signal content and augmented in noise reduction algorithms or misclassified as an utterance in speech recognition applications.

Therefore there is a need for a system that counteracts passing tire hiss noise.

SUMMARY

A voice enhancement logic improves the perceptual quality of a processed voice. The system detects and dampens some noises associated with moving tires. The system includes a passing tire hiss noise detector and a passing tire hiss noise attenuator. The passing tire hiss noise detector may detect a passing tire hiss noise by comparing the input signal to a passing tire hiss model. The passing tire hiss noise attenuator then dampens the passing tire hiss. The system may also detect, dampen and/or attenuate continuous noise or other transient noises.

Alternative voice enhancement logic includes time frequency transform logic, a background noise estimator, a passing tire hiss noise detector, and a passing tire hiss noise attenuator. The time frequency transform logic converts a time varying input signal into a frequency domain output signal. The background noise estimator measures the continuous noise that may accompany the input signal. The passing tire hiss noise detector automatically identifies and models passing tire hiss noise, which may then be dampened by the passing tire hiss noise attenuator.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

A voice enhancement logic improves the perceptual quality of a processed voice. The logic may automatically detect the shape and form of the noise associated with the hiss of tires of vehicles passing the receiver in a real or a delayed time. By tracking selected attributes, the logic may eliminate or dampen passing tire hiss noise using a limited memory that temporarily stores the selected attributes of the noise. The passing tire hiss noise can be detected and attenuated in the presence or absence of speech. The passing tire hiss noise may be detected and attenuated with some time buffering (e.g. 300-500 ms), or alternatively, the presence of passing tire hiss noise may be predicted based on modeled passing tire hiss noise and attenuated in real time. Alternatively or additionally, the logic may also dampen a continuous noise and/or the "musical noise," squeaks, squawks, chirps, clicks, drips, pops, tones, or other sound artifacts that may be generated by some voice enhancement systems.

Figure 1:
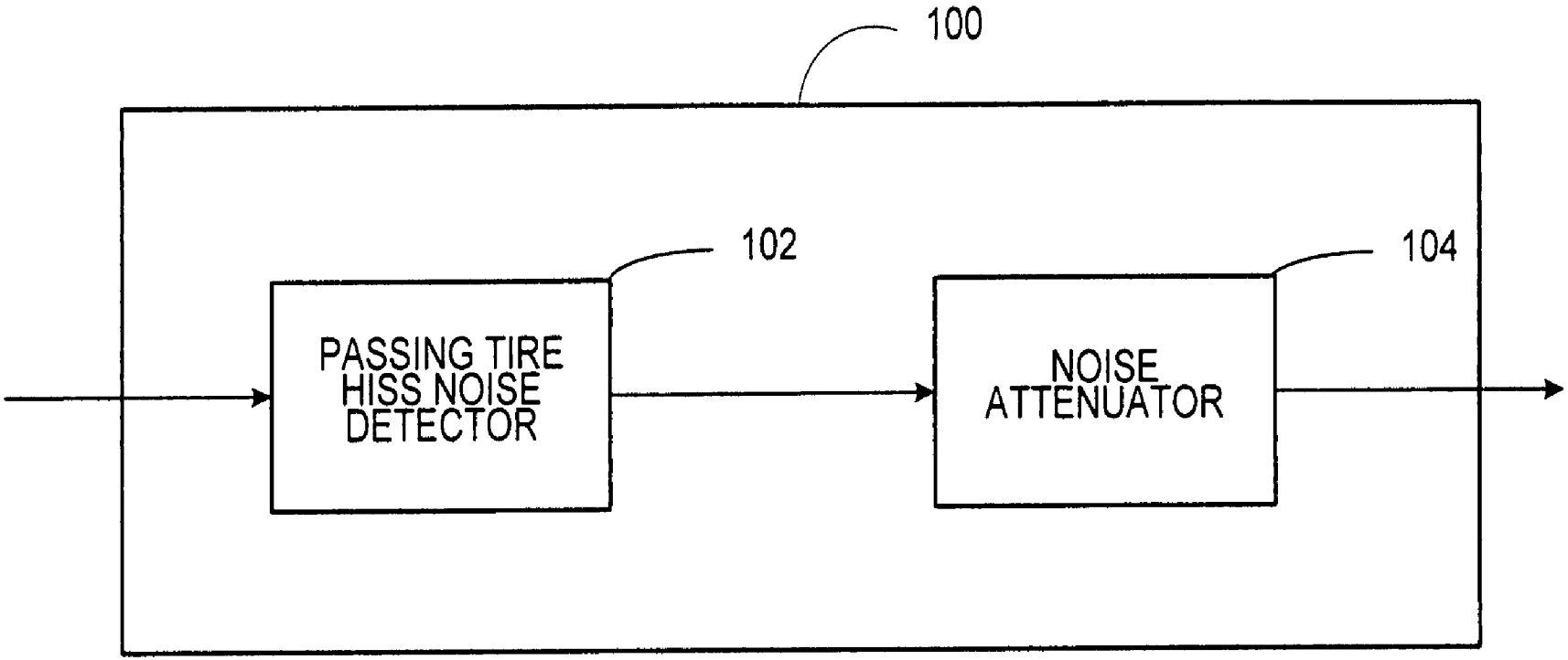
FIG. 1 is a partial block diagram of voice enhancement logic.

FIG. 1 is a partial block diagram of the voice enhancement logic 100. The voice enhancement logic may encompass hardware or software that is capable of running on one or more processors. The one or more processors may also be running zero, one or multiple operating systems. The highly portable logic includes a passing tire hiss noise detector 102 and a noise attenuator 104.

In FIG. 1 the passing tire hiss noise detector 102 may identify and model a noise associated with the hiss of tires of vehicles passing the receiver. While passing tire hiss noise occurs over a broad frequency range, the passing tire hiss noise detector 102 may be configured to detect and model the passing tire hiss noise that is received by the receiver at frequencies of interest. The passing tire hiss noise detector receives incoming sound, that in the short term spectra, may be classified into three broad categories: (1) Noise, which is the undesired sounds that are not part of the original speech signal; (2) Speech, which is the desired sounds part of the original speech signal; (3) Noise plus speech, which is a mixture of (1) and (2).

Noise can be broadly divided into two categories: (1a) non-periodic noises, which include sounds like passing tire hiss, rain, wind, and share the traits that they usually occur at non-periodic intervals, don't have a harmonic frequency structure, and have a transient, short time duration; (1b) periodic noises, which include repetitive sounds like turn indicator clicks, engine or drive train noise and windshield wiper swooshes and may have some harmonic frequency structure due to their periodic nature. Speech can also be broadly divided into two categories: (2a) unvoiced speech, such as consonants, without harmonic or formant structure; (2b) voiced speech, such as vowel sounds, which exhibits a regular harmonic structure, or harmonic peaks weighted by the spectral envelope that may describe the formant structure. Noise plus speech may comprise any mixture of non-periodic noises, periodic noises, unvoiced speech and/or voiced speech.

The passing tire hiss noise detector 102 may separate the noise-like segments from the remaining signal in a real or in a delayed time no matter how complex or how loud an incoming segment may be. The separated noise-like segments are analyzed to detect the occurrence of passing tire hiss noise, and in some instances, the presence of a continuous underlying noise. When passing tire hiss noise is detected, the spectrum is modeled, and the resulting passing tire hiss model is retained in a memory for use by the passing tire hiss noise attenuator 104. While the passing tire hiss noise detector 102 may store an entire model of a passing tire hiss noise signal, it also may store selected attributes in a memory. The stored passing tire hiss models may be used to create an average passing tire hiss model, or otherwise combined for future use by the passing tire hiss noise detector 102 or the passing tire hiss noise attenuator 104.

To overcome the effects of passing tire hiss noise, the passing tire hiss noise attenuator 104 substantially removes or dampens the passing tire hiss noise from the input signal. The voice enhancement logic 100 encompasses any system that substantially removes or dampens passing tire hiss noise. Examples of systems that may dampen or remove passing tire hiss noise include systems that use a signal and a passing tire hiss noise model such as (1) systems which use a neural network mapping of a noisy signal and a passing tire hiss model to a noise-reduced signal, (2) systems which subtract the passing tire hiss model from a noisy signal, (3) systems that use the noisy signal and the passing tire hiss model to select a noise-reduced signal from a code-book, (4) systems that in any other way use the noisy signal and the passing tire hiss model to create a noise-reduced signal based on a reconstruction or reduction of the masked signal. These systems may attenuate passing tire hiss noise, and in some instances, attenuate the continuous noise that may be part of the short-term spectra. The passing tire hiss noise attenuator 104 may also interface or include an optional residual attenuator that removes or dampens artifacts that may result in the processed signal. The residual attenuator may remove the "musical noise," squeaks, squawks, chirps, clicks, drips, pops, tones, or other sound artifacts.

Figure 2:
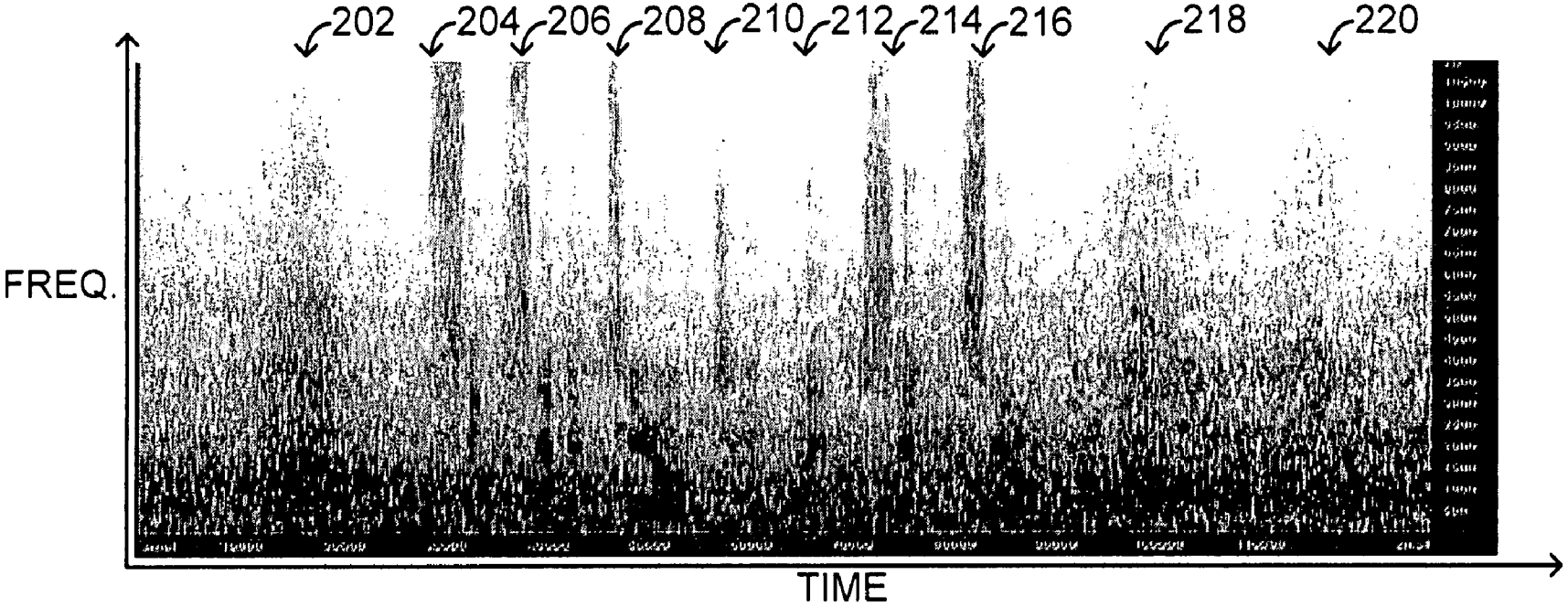
FIG. 2 is a time-frequency spectrogram illustrating a signal having a sequence of sounds.

FIG. 2 is a time-frequency spectrogram illustrating a signal having a sequence of sounds comprising, from left to right, a simulated passing tire hiss noise 202, a voiced string of the digits "6702177" (indicated by reference characters 204, 206, 208, 210, 212, 214 and 216, respectively), and two real passing tire hiss noises 218 and 220. The simulated passing tire hiss noise 202 was generated using a broadband amplification in the frequency domain and a smoothly-varying function in the time domain that ramps smoothly upwardly then smoothly downwardly. Examples of suitable functions in the time domain include a Lorentzian function, a Gaussian function, a sine wave, and a smoothed triangular wave. As can be seen in FIG. 2, the simulated passing tire hiss noise 202 has a shape which is almost identical to the shapes of the two real passing tire hiss noises 218 and 220.

Figure 3:
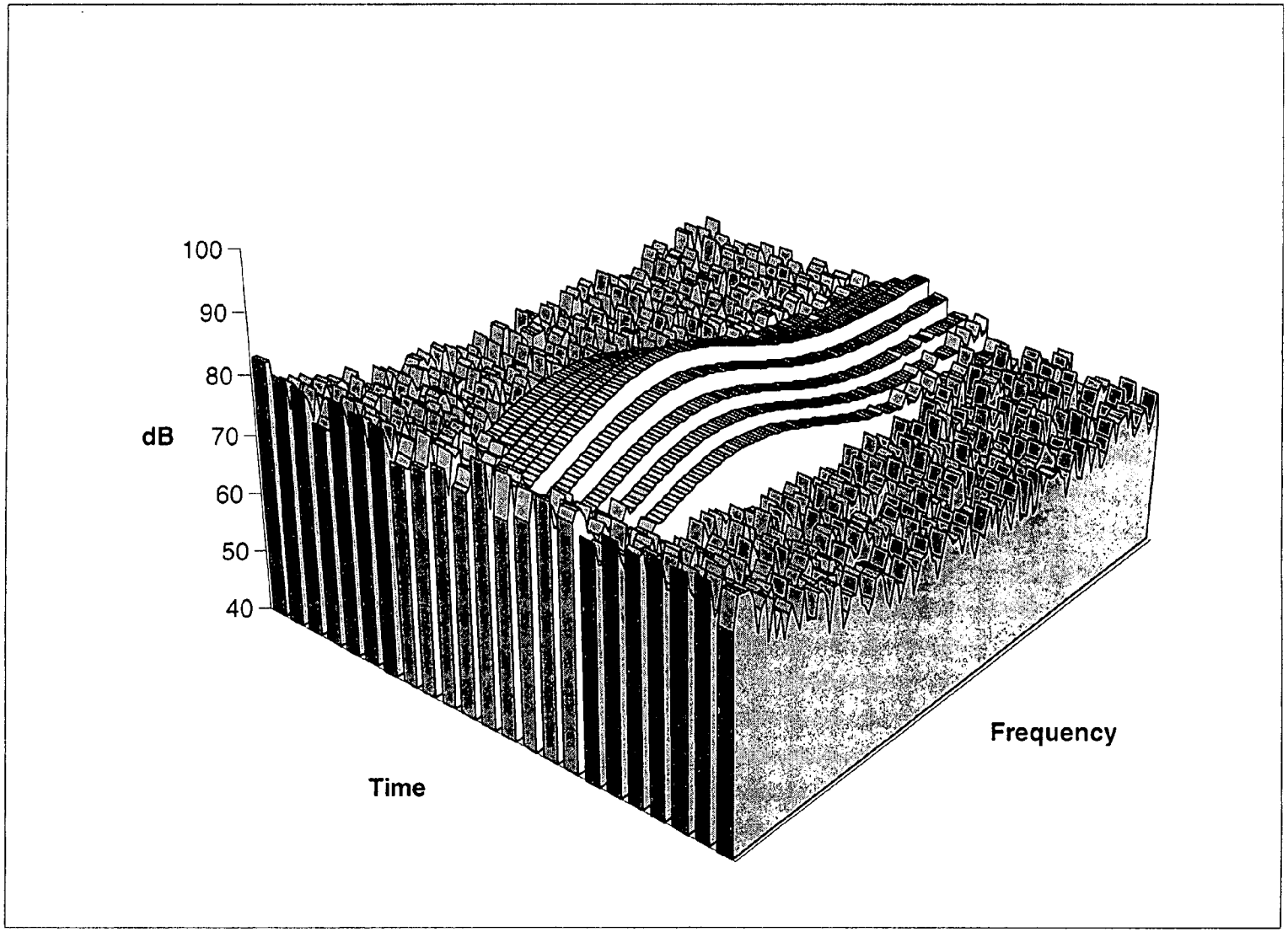
FIG. 3 shows a signal comprising passing tire hiss noise plus background noise, in the time-frequency domain.
Figure 4:
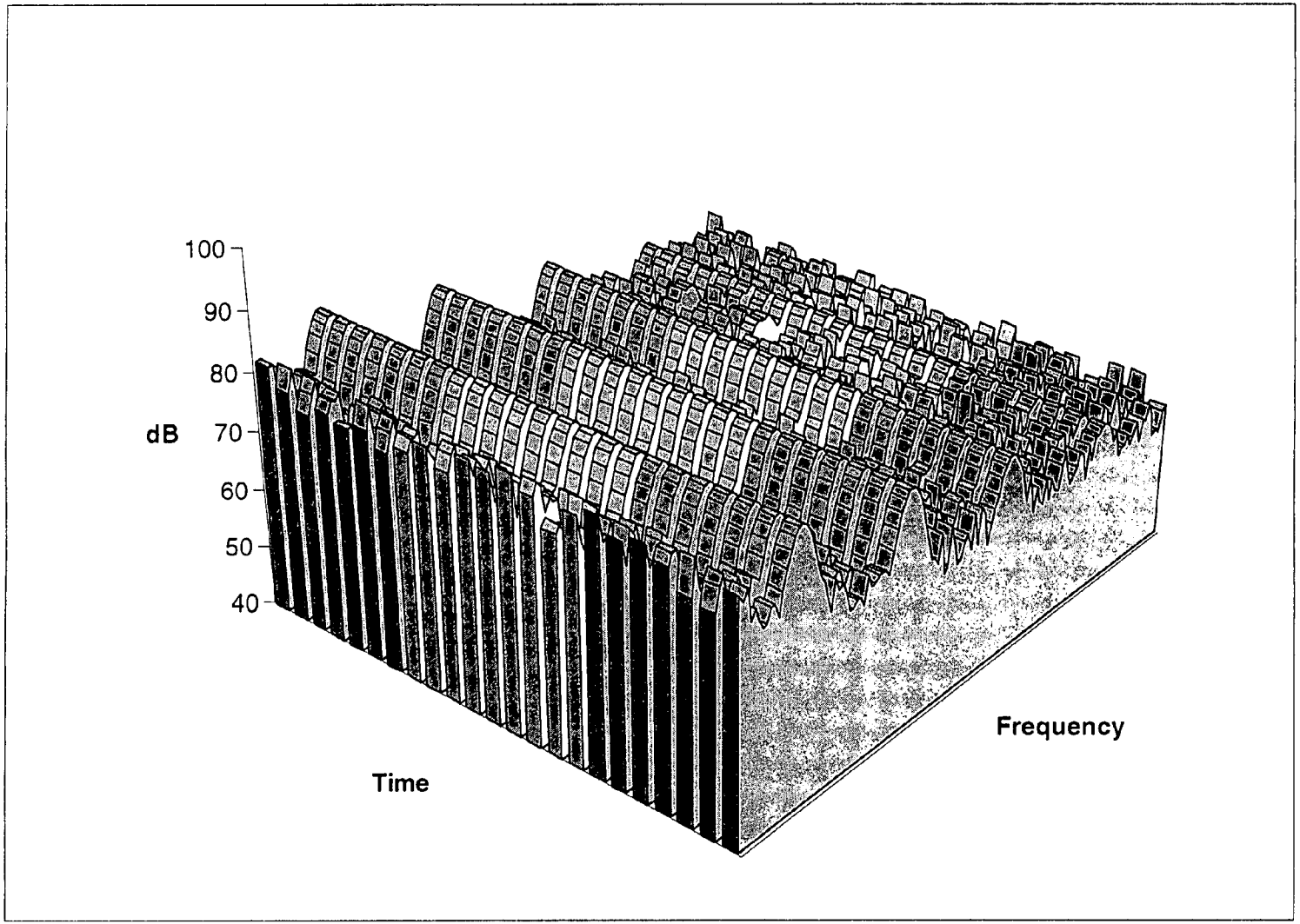
FIG. 4 shows a signal comprising a vowel sound plus background noise, in the time-frequency domain.

FIG. 3 shows an example signal comprising passing tire hiss noise plus background noise, in the time-frequency domain. FIG. 4 shows an example signal comprising a vowel sound plus background noise, in the time-frequency domain. It can be seen from FIGS. 3 and 4 that the shape of passing tire hiss noise in the time-frequency domain is distinct from that of voiced signals such as vowel sounds. A passing tire hiss detector 102 may use time-frequency modeling to discriminate passing tire hiss noise from speech signals.

Figure 5:
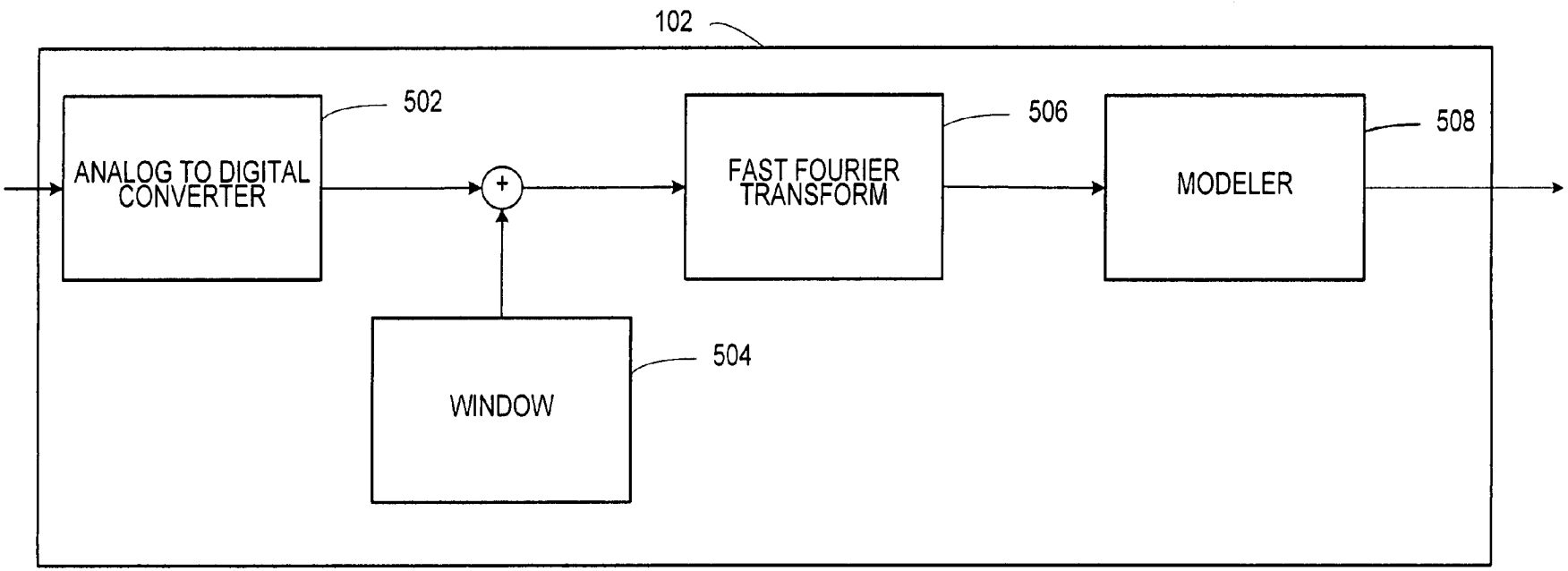
FIG. 5 is a block diagram of the passing tire hiss noise detector of the voice enhancement logic of FIG. 1.

FIG. 5 is a block diagram of an example passing tire hiss noise detector 102 that may receive or detect an input signal comprising noise, speech, and/or noise plus speech. A received or detected signal is digitized at a predetermined frequency. To assure a good quality voice, the voice signal is converted to a pulse-code-modulated (PCM) signal by an analog-to-digital converter 502 (ADC) having any common sample rate. A smooth window 504 is applied to a block of data to obtain the windowed signal. The complex spectrum for the windowed signal may be obtained by means of a fast Fourier transform (FFT) 506 that separates the digitized signal into frequency bins, with each bin identifying an amplitude and phase across a small frequency range. The spectral components of the frequency bins may be monitored over time by a modeler 508.

To detect a passing tire hiss, modeler 508 may fit a smoothly-varying function to a selected portion of the signal in the time-frequency domain. The smoothly-varying function may be a log-Lorentzian function, with a width determined by the speed of the passing vehicle generating the passing tire hiss noise, and a sharpness determined by the lateral distance of the passing vehicle from the receiver. A correlation between a smoothly-varying function and the signal envelope in the time domain over one or several frequency bands may identify a passing tire hiss. The correlation threshold at which a portion of the signal is identified as a passing tire hiss noise may depend on a desired clarity of a processed voice and the variations in width and sharpness of the passing tire hiss noise. Alternatively or additionally, the system may determine a probability that the signal includes passing tire hiss noise, and may identify a passing tire hiss noise when that probability exceeds a probability threshold. The correlation and probability thresholds may depend on various factors, including the presence of other noises or speech in the input signal. When the passing tire hiss noise detector 102 detects a passing tire hiss, the characteristics of the detected passing tire hiss may be provided to the passing tire hiss noise attenuator 104 for removal of the passing tire hiss noise.

As more windows of sound are processed, the passing tire hiss noise detector 102 may derive average noise models for the passing tire hiss. A time-smoothed or weighted average may be used to model the passing tire hiss and continuous noise estimates for each frequency bin. The average model may be updated when a passing tire hiss noise is detected in the absence of speech. Fully bounding a passing tire hiss noise when updating the average model may increase the probability of accurate detection.

To limit a masking of voice, the fitting of the smoothly-varying function to a suspected passing tire hiss noise may be constrained by rules. For example, a spectral flatness measure may be used to differentiate passing tire hiss noise from voiced signals, and may improve the accuracy of passing tire hiss noise detection, since passing tire hiss is broad spectrum noise and has a fairly smooth spectral shape, unlike voiced signals. Alternatively or additionally, in a vehicle equipped with MOST bus or similar technology, the voice enhancement logic 100 may be provided with information about whether or not the windows are open and passing tire hiss noise detection may be disabled or constrained when the windows are closed.

To overcome the effects of passing tire hiss noise, a passing tire hiss noise attenuator 104 may substantially remove or dampen the passing tire hiss noise from the signal by any method. One method may add the passing tire hiss model to a recorded or estimated continuous noise. In the power spectrum, the passing tire hiss model and continuous noise may then be subtracted from the unmodified signal. If an underlying speech signal is masked by a passing tire hiss or continuous noise, a conventional or modified interpolation method may be used to reconstruct the speech signal. A linear or step-wise interpolator may be used to reconstruct the missing part of the signal. An inverse FFT may then be used to convert the signal power to the time domain, which provides a reconstructed speech signal.

To minimize the "music noise," squeaks, squawks, chirps, clicks, drips, pops, or other sound artifacts, an optional residual attenuator may also condition the voice signal before it is converted to the time domain. The residual attenuator may be combined with a passing tire hiss noise attenuator 104, combined with one or more other elements, or comprise a separate element.

The residual attenuator may track the power spectrum within a mid to high frequency range (e.g., from about 400 Hz up to about the Nyquist frequency, which is about one half the sample rate). When a large increase in signal power is detected an improvement may be obtained by limiting or dampening the transmitted power in the mid to high frequency range to a predetermined or calculated threshold. A calculated threshold may be equal to, or based on, the average spectral power of that same mid to high frequency range at an earlier period in time.

Figure 6:
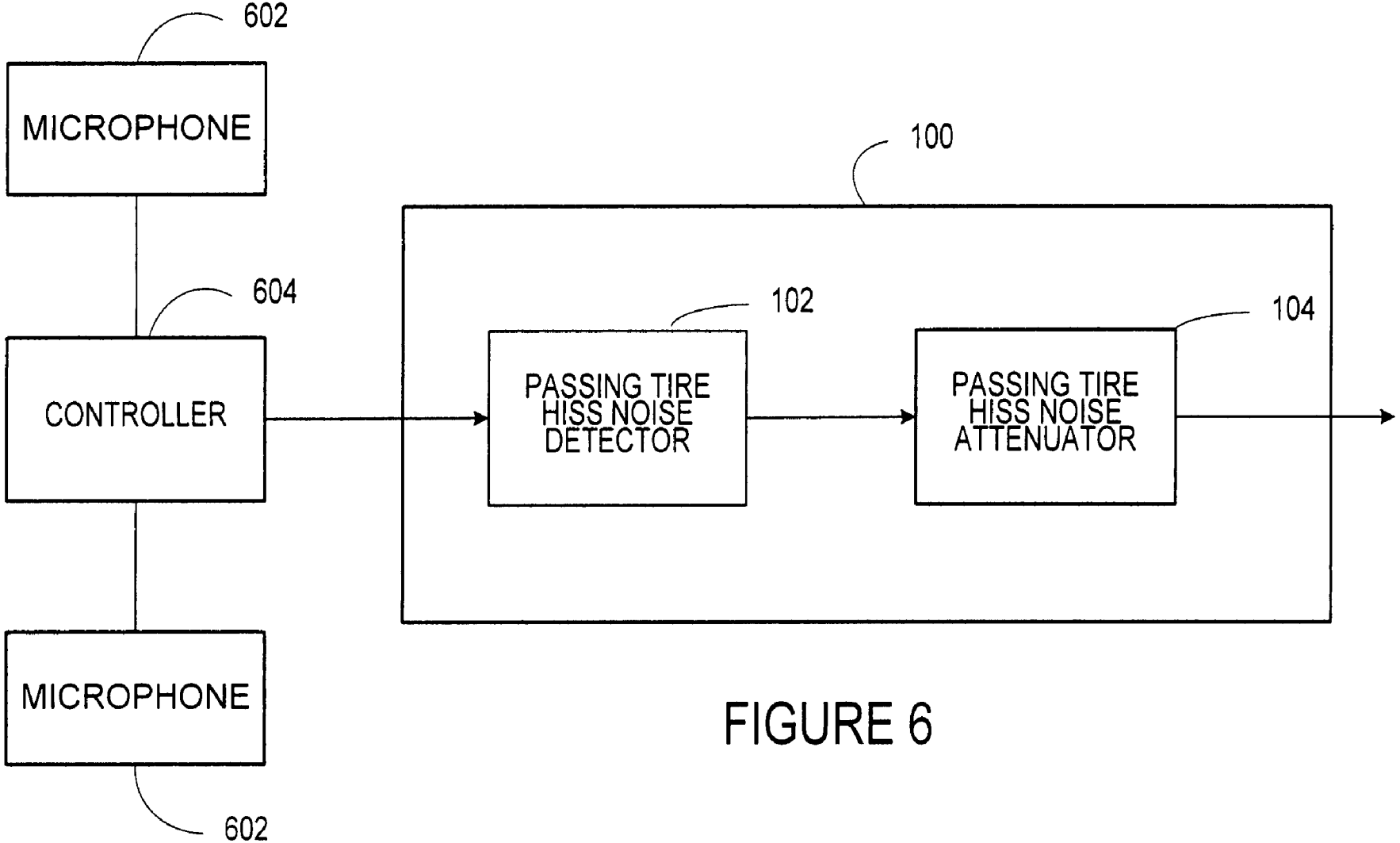
FIG. 6 is a pre-processing system coupled to the voice enhancement logic of FIG. 1.

Further improvements to voice quality may be achieved by pre-conditioning the input signal before it is processed by the passing tire hiss noise detector 102. One pre-processing system may exploit the lag time caused by a signal arriving at different detectors that are positioned apart as shown in FIG. 6 at different times. If multiple detectors or microphones 602 are used that convert sound into an electric signal, the pre-processing system may include a controller 604 that automatically selects the microphone 602 and channel that senses the least amount of noise. When another microphone 602 is selected, the electric signal may be combined with the previously generated signal before being processed by the passing tire hiss noise detector 102.

Alternatively, passing tire hiss noise detection may be performed on each of the channels. A mixing of one or more channels may occur by switching between the outputs of the microphones 602. Alternatively or additionally, the controller 604 may include a comparator, and a direction of the signal may be detected from differences in the amplitude or timing of signals received from the microphones 602. Direction detection may be improved by pointing the microphones 602 in different directions. The passing tire hiss noise detection may be made more sensitive for signals originating outside of the vehicle.

The signals may be evaluated at only frequencies above a certain threshold (for example, by using a high-pass filter) which are of interest in certain applications. The threshold frequency may be updated over time as the average passing tire hiss model learns the expected frequencies of passing tire hiss noises. For example, when passing vehicles are traveling at high speeds, the threshold frequency for passing tire hiss noise detection may be set relatively high, since the maximum frequency of passing tire hiss noise increases with vehicle speed. Alternatively, controller 604 may combine the output signals of multiple microphones 602 at a specific frequency or frequency range through a weighting function.

Figure 7:
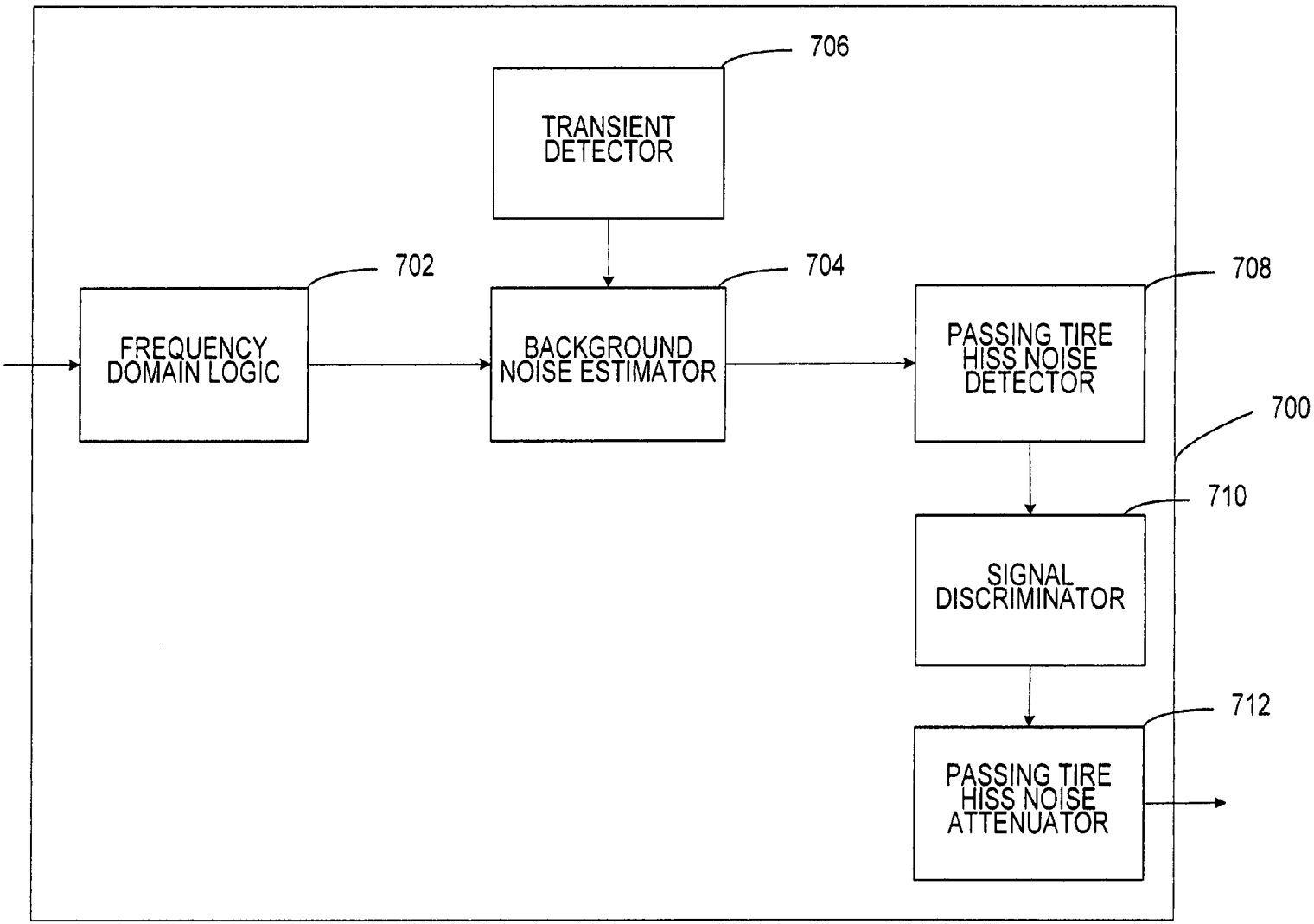
FIG. 7 is a block diagram of an alternative voice enhancement system.

FIG. 7 shows alternative voice enhancement logic 700 that also improves the perceptual quality of a processed voice. The enhancement is accomplished by time-frequency transform logic 702 that digitizes and converts a time varying signal to the frequency domain. A background noise estimator 704 measures the continuous or ambient noise that occurs near a sound source or the receiver. The background noise estimator 704 may comprise a power detector that averages the acoustic power in each frequency bin in the power, magnitude, or logarithmic domain.

To prevent biased background noise estimations at transients, a transient detector 706 may disable or modulate the background noise estimation process during abnormal or unpredictable increases in power. In FIG. 7, the transient detector 706 disables the background noise estimator 704 when an instantaneous background noise B(f, i) exceeds an average background noise B(f)Ave by more than a selected decibel level 'c.' This relationship may be expressed as:

$$B(f,i)>B(f)\text{Ave}+c \qquad \text{(Equation 1)}$$

Alternatively or additionally, the average background noise may be updated depending on the signal to noise ratio (SNR). An example closed algorithm is one which adapts a leaky integrator depending on the SNR:

$$B(f)\text{Ave}'=aB(f)\text{Ave}+(1-a)S \qquad \text{(Equation 2)}$$

where a is a function of the SNR and S is the instantaneous signal. In this example, the higher the SNR, the slower the average background noise is adapted.

To detect a passing tire hiss, passing tire hiss noise detector 708 may fit a smoothly-varying function to a selected portion of the signal in the time-frequency domain. The smoothly-varying function may be a log-Lorentzian function, with a width determined by the speed of the passing vehicle generating the passing tire hiss noise, and a sharpness determined by the lateral distance of the passing vehicle from the receiver. A correlation between a smoothly-varying function and the signal envelope in the time domain over one or more frequency bands may identify a passing tire hiss. The correlation threshold at which a portion of the signal is identified as a passing tire hiss noise may depend on a desired clarity of a processed voice and the variations in width and sharpness of the passing tire hiss noise. Alternatively or additionally, the system may determine a probability that the signal includes passing tire hiss noise, and may identify a passing tire hiss noise when that probability exceeds a probability threshold. The correlation and probability thresholds may depend on various factors, including the presence of other noises or speech in the input signal. When the noise detector 708 detects a passing tire hiss, the characteristics of the detected passing tire hiss may be provided to the noise attenuator 712 for removal of the passing tire hiss noise.

A signal discriminator 710 may mark the voice and noise of the spectrum in real or delayed time. Any method may be used to distinguish voice from noise. Spoken signals may be identified by (1) the narrow widths of their bands or peaks; (2) the broad resonances, which are also known as formants, which may be created by the vocal tract shape of the person speaking; (3) the rate at which certain characteristics change with time (i.e., a time-frequency model can be developed to identify spoken signals based on how they change with time); and when multiple detectors or microphones are used, (4) the correlation, differences, or similarities of the output signals of the detectors or microphones.

Figure 8:
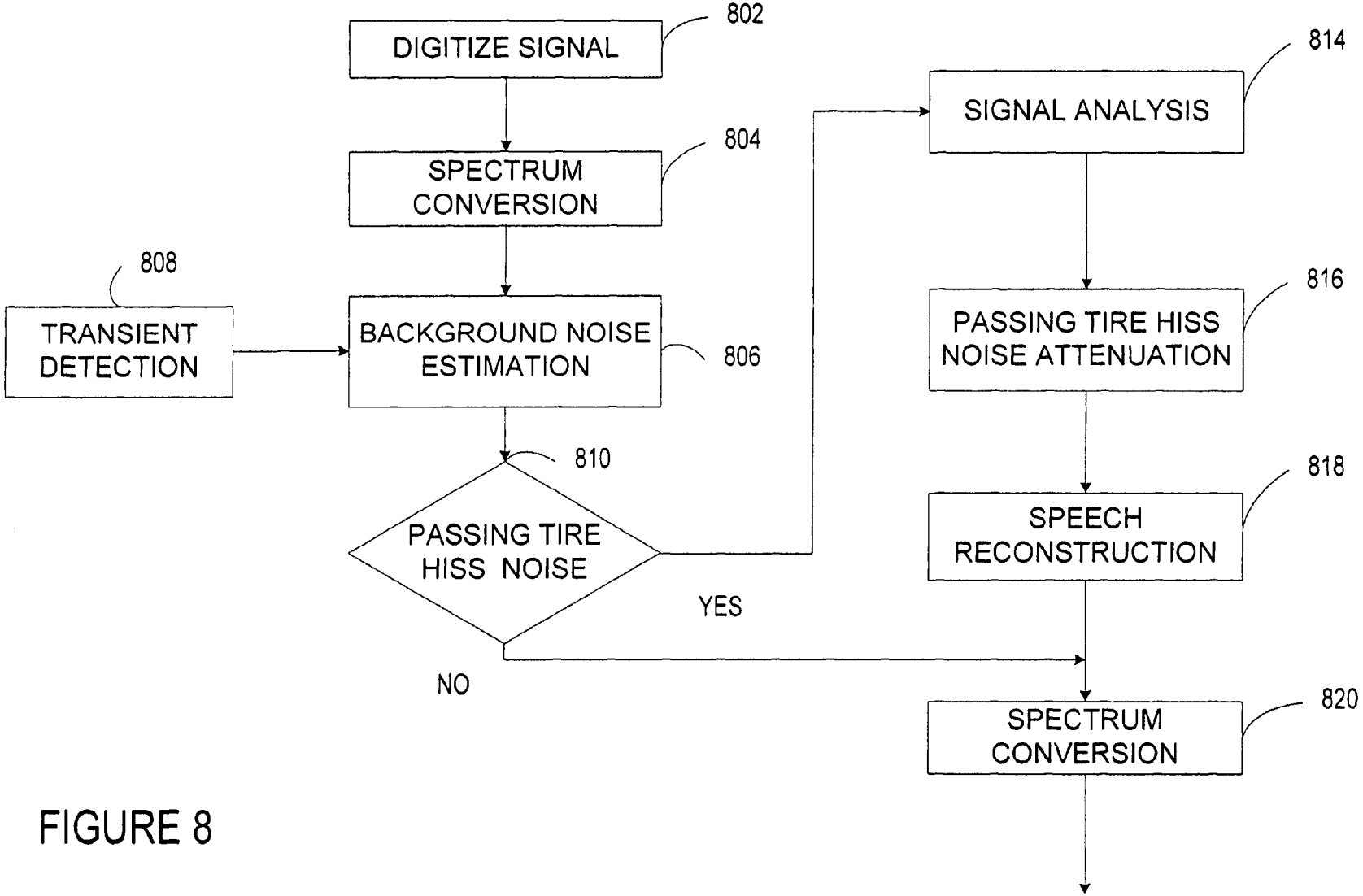
FIG. 8 is a flow diagram of a voice enhancement.

FIG. 8 is a flow diagram of a voice enhancement that removes some passing tire hiss noise and continuous noise to enhance the perceptual quality of a processed voice. At act 802 a received or detected signal is digitized at a predetermined frequency. To assure a good quality voice, the voice signal may be converted to a PCM signal by an ADC. At act 804 a complex spectrum for the windowed signal may be obtained by means of an FFT that separates the digitized signals into frequency bins, with each bin identifying an amplitude and a phase across a small frequency range.

At act 806, a continuous or ambient noise is measured. The background noise estimate may comprise an average of the acoustic power in each frequency bin. To prevent biased noise estimations at transients, the noise estimation process may be disabled during abnormal or unpredictable increases in power at act 808. The transient detection act 808 disables the background noise estimate when an instantaneous background noise exceeds an average background noise by more than a predetermined decibel level.

At act 810, a passing tire hiss noise may be detected when a high correlation exists between a smoothly function and the temporal and/or spectral characteristics of the input signal in the time and/or frequency domains. The detection of a passing tire hiss noise may be constrained by one or more optional acts. For example, if a vowel or another harmonic structure is detected, the passing tire hiss noise detection method may limit the passing tire hiss noise correction to values less than or equal to average values. An additional optional act may allow the average passing tire hiss model or attributes to be updated only during unvoiced segments. If a speech or speech mixed with noise segment is detected, the average passing tire hiss model or attributes are not updated under this act. If no speech is detected, the passing tire hiss model or each attribute may be updated through many means, such as through a weighted average or a leaky integrator. Many other optional acts may also be applied to the model.

If passing tire hiss noise is detected at act 810, at act 814, a signal analysis may discriminate or mark the spoken signal from the noise-like segments. Spoken signals may be identified by (1) the narrow widths of their bands or peaks; (2) the broad resonances, which are also known as formants, which may be created by the vocal tract shape of the person speaking; (3) the rate at which certain characteristics change with time (i.e., a time-frequency model can be developed to identify spoken signals based on how they change with time); and when multiple detectors or microphones are used, (4) the correlation, differences, or similarities of the output signals of the detectors or microphones.

To overcome the effects of passing tire hiss noise, a passing tire hiss noise is substantially removed or dampened from the noisy spectrum by any act. One exemplary act 816 adds the smoothly varying passing tire hiss model to a recorded or modeled continuous noise. In the power spectrum, the modeled noise may then be substantially removed from the unmodified spectrum by the methods and systems described above. If an underlying speech signal is masked by a passing tire hiss noise, or masked by a continuous noise, a conventional or modified interpolation method may be used to reconstruct the speech signal at act 818. A time series synthesis may then be used to convert the signal power to the time domain at act 820, which provides a reconstructed speech signal. If no passing tire hiss noise is detected at act 810, at act 820 the signal is converted into the time domain to provide the reconstructed speech signal.

Alternatively, a passing tire hiss noise attenuator may substantially remove or dampen the passing tire hiss from the signal by any method. One method may add the passing tire hiss model to a recorded or estimated continuous noise. In the power spectrum, the passing tire hiss model and the continuous noise may then be subtracted from the unmodified signal.

Figure 9:
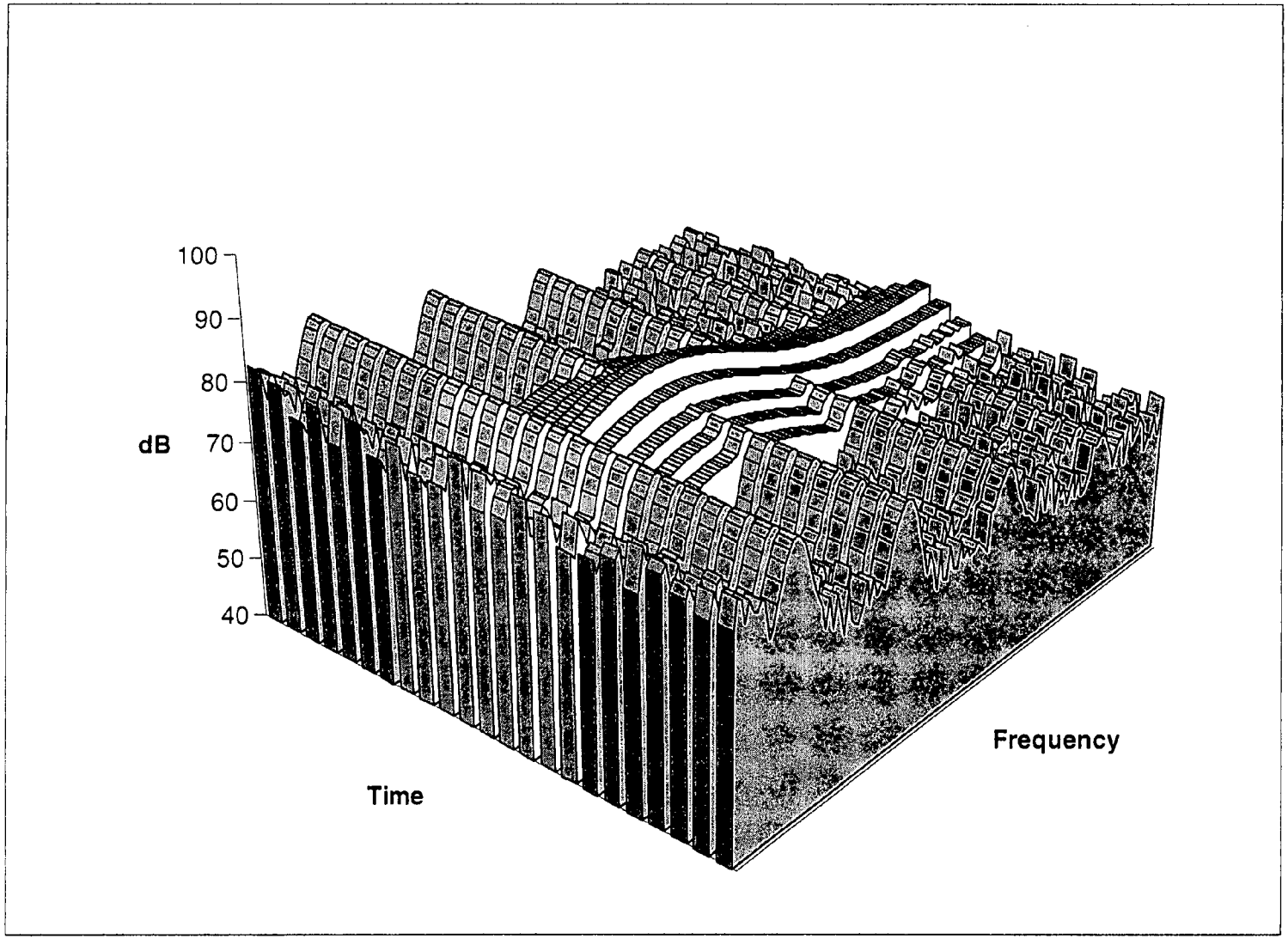
FIG. 9 shows a signal comprising both a vowel sound and a passing tire hiss noise in the time-frequency domain.
Figure 10:
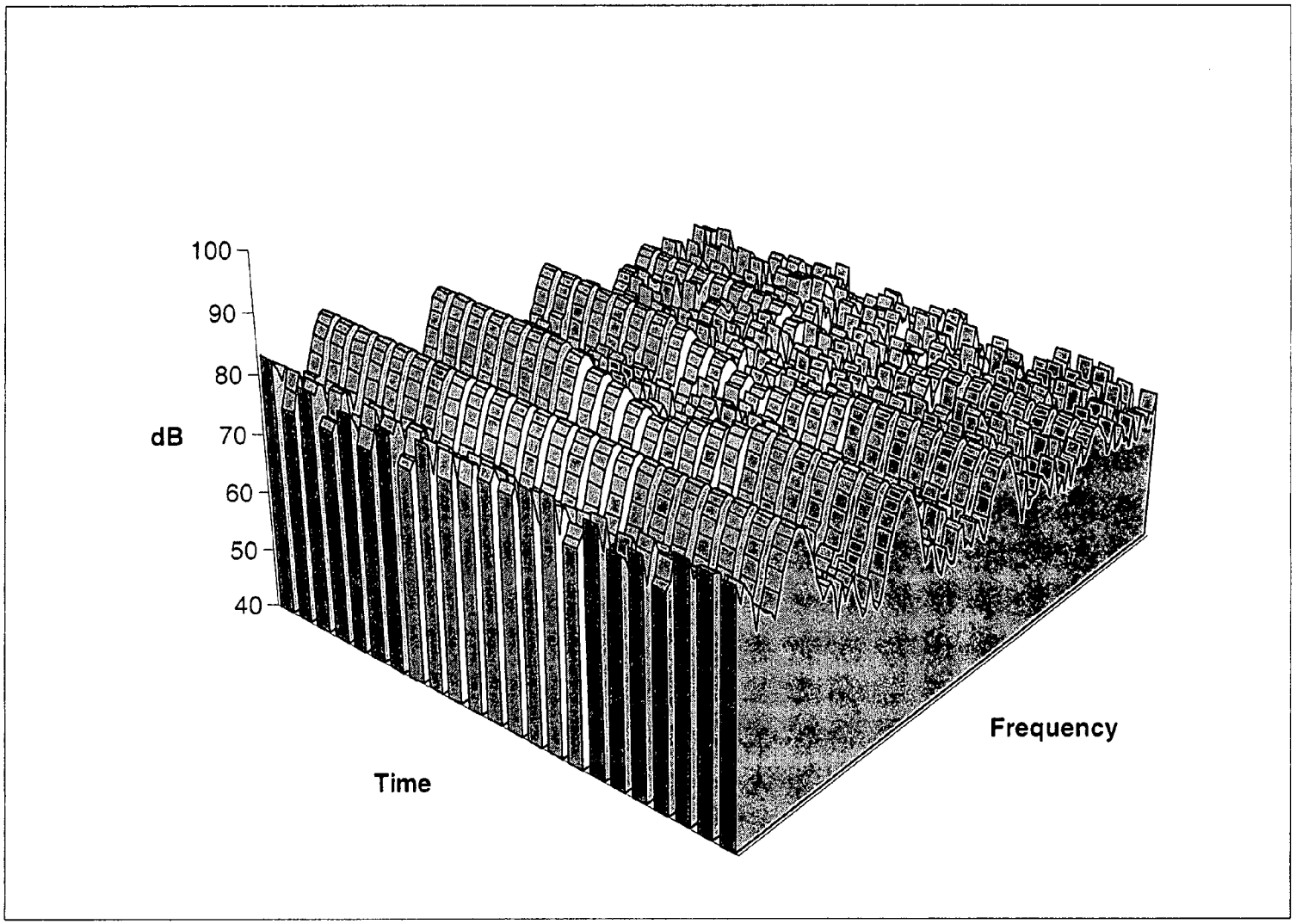
FIG. 10 shows the signal of FIG. 9 with the passing tire hiss removed in the time-frequency domain.
Figure 11:
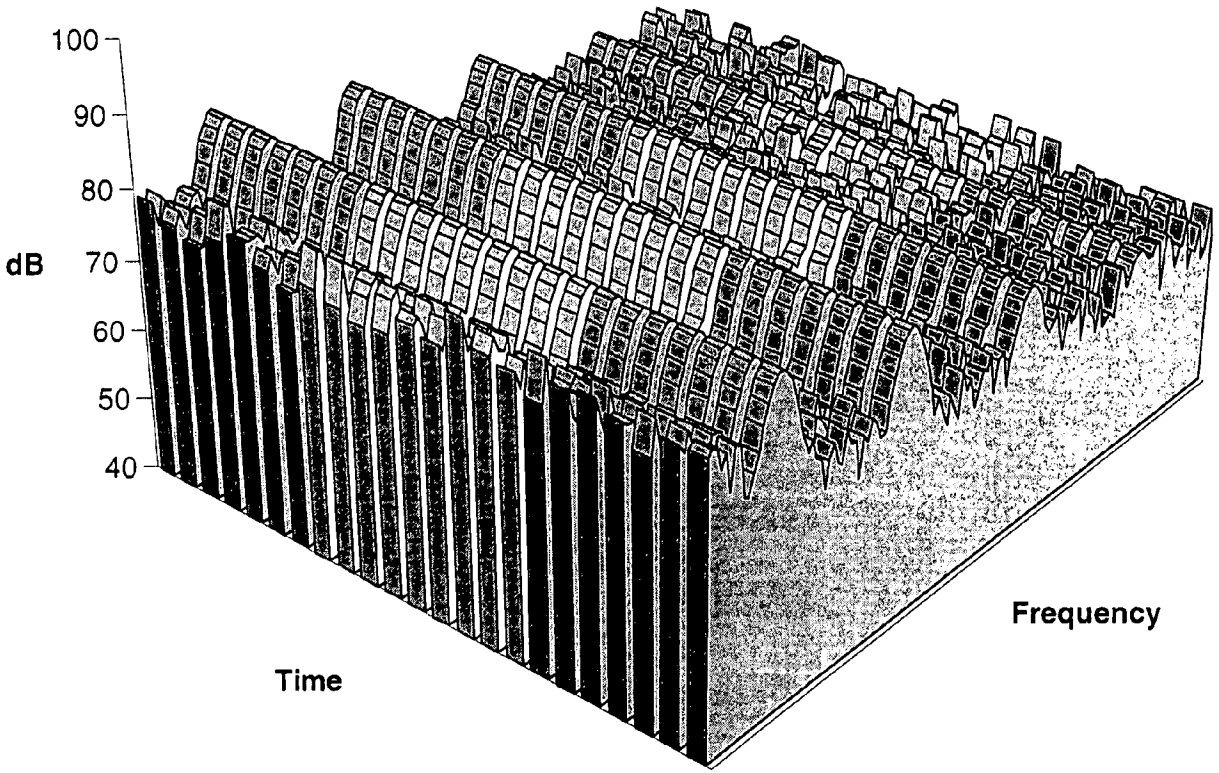
FIG. 11 shows the signal of FIG. 10 with a reconstructed vowel sound in the time-frequency domain.

If an underlying speech signal is masked by passing tire hiss or continuous noise, a conventional or modified interpolation method may be used to reconstruct the speech signal. FIG. 9 shows an example signal comprising both a vowel sound and a passing tire hiss noise. FIG. 10 shows the signal with the passing tire hiss removed, and FIG. 11 shows the signal with a reconstructed vowel sound. A linear or step-wise interpolator may be used to reconstruct the missing part of the signal. An inverse FFT may then be used to convert the signal power to the time domain, which provides a reconstructed voice signal.

The method shown in FIG. 8 may be encoded in a signal bearing medium, a computer readable medium such as a memory, programmed within a device such as one or more integrated circuits, or processed by a controller or a computer. If the methods are performed by software, the software may reside in a memory resident to or interfaced to the passing tire hiss noise detector 102, a communication interface, or any other type of non-volatile or volatile memory interfaced or resident to the voice enhancement logic 100 or 700. The memory may include an ordered listing of executable instructions for implementing logical functions. A logical function may be implemented through digital circuitry, through source code, through analog circuitry, or through an analog source such through an analog electrical, audio, or video signal. The software may be embodied in any computer-readable or signal-bearing medium, for use by, or in connection with an instruction executable system, apparatus, or device. Such a system may include a computer-based system, a processor-containing system, or another system that may selectively fetch instructions from an instruction executable system, apparatus, or device that may also execute instructions.

A "computer-readable medium," "machine-readable medium," "propagated-signal" medium, and/or "signal-bearing medium" may comprise any means that contains, stores, communicates, propagates, or transports software for use by or in connection with an instruction executable system, apparatus, or device. The machine-readable medium may selectively be, but not limited to, an electronic, magnetic, optical, electromagnetic, infrared, or semiconductor system, apparatus, device, or propagation medium. A non-exhaustive list of examples of a machine-readable medium would include: an electrical connection "electronic" having one or more wires, a portable magnetic or optical disk, a volatile memory such as a Random Access Memory "RAM" (electronic), a Read-Only Memory "ROM" (electronic), an Erasable Programmable Read-Only Memory (EPROM or Flash memory) (electronic), or an optical fiber (optical). A machine-readable medium may also include a tangible medium upon which software is printed, as the software may be electronically stored as an image or in another format (e.g., through an optical scan), then compiled, and/or interpreted or otherwise processed. The processed medium may then be stored in a computer and/or machine memory.

The above-described systems may condition signals received from only one or more than one microphone or detector. Many combinations of systems may be used to identify and track passing tire hiss noises. Besides the fitting of a smoothly varying function to a suspected passing tire hiss, a system may detect and isolate any parts of the signal having greater energy than the modeled passing tire hiss. One or more of the systems described above may also be used in alternative voice enhancement logic.

Other alternative voice enhancement systems include combinations of the structure and functions described above. These voice enhancement systems are formed from any combination of structure and function described above or illustrated within the attached figures. The logic may be implemented in software or hardware. The term "logic" is intended to broadly encompass a hardware device or circuit, software, or a combination. The hardware may include a processor or a controller having volatile and/or non-volatile memory and may also include interfaces to peripheral devices through wireless and/or hardwire mediums.

Figure 12:
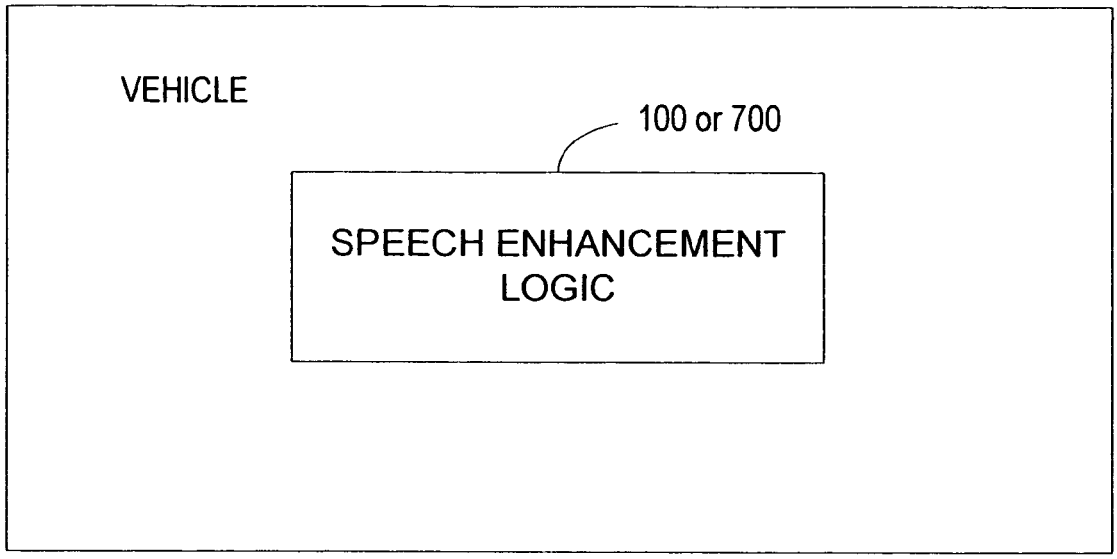
FIG. 12 is a block diagram of voice enhancement logic within a vehicle.
Figure 13:
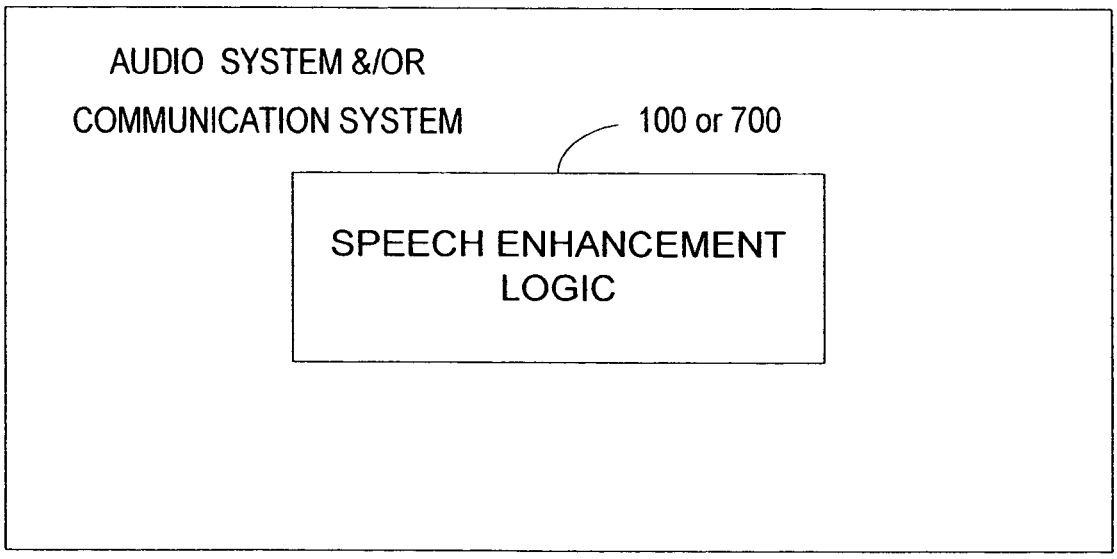
FIG. 13 is a block diagram of voice enhancement logic interfaced to an audio system and/or a communication system.

The voice enhancement logic is easily adaptable to any technology or devices. Some voice enhancement systems or components interface or couple vehicles as shown in FIG. 12, instruments that convert voice and other sounds into a form that may be transmitted to remote locations, such as landline and wireless telephones and audio equipment as shown in FIG. 13, and other communication systems that may be susceptible to passing tire hiss noise.

The voice enhancement logic improves the perceptual quality of a processed voice. The logic may automatically learn and encode the shape and form of the noise associated with passing tire hiss in a real or a delayed time. By tracking selected attributes, the logic may eliminate, substantially eliminate, or dampen passing tire hiss noise using a limited memory that temporarily or permanently stores selected attributes of the passing tire hiss noise. The voice enhancement logic may also dampen a continuous noise and/or the squeaks, squawks, chirps, clicks, drips, pops, tones, or other sound artifacts that may be generated within some voice enhancement systems and may reconstruct voice when needed.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A system for suppressing passing tire hiss noise from a signal, comprising:

a noise detector that detects and models a passing tire hiss from an input signal; and a noise attenuator electrically connected to the noise detector to attenuate at least a portion of the passing tire hiss from the input signal;

where the noise detector is configured to identify whether the input signal includes the passing tire hiss by fitting a smoothly varying function to a portion of the input signal.

2. The system of claim 1 where the noise detector is configured to identify whether the input signal includes passing tire hiss by fitting a Lorentzian function to a portion of the input signal in a time domain.

3. The system of claim 1 where the noise detector is configured to model the passing tire hiss by fitting the smoothly varying function to the input signal in a time-frequency domain.

4. The system of claim 1 where the noise detector is configured to constrain a passing tire hiss adaptation when a structure similar to a vowel or a harmonic like structure is detected.

5. The system of claim 1 where the noise detector is configured to receive information from an automotive bus and to selectively constrain a passing tire hiss adaptation based on the information received from the automotive bus.

6. The system of claim 5 where the noise detector is configured to receive information from the automotive bus about whether widows of a vehicle are open or closed, and where the noise detector is configured to disable or constrain passing tire hiss noise detection when the windows are closed.

7. The system of claim 1 where the noise detector is configured to derive an average passing tire hiss model, and the average passing tire hiss model is not updated near a speech or speech plus noise signal.

8. The system of claim 1 where the noise detector is configured to derive an average passing tire hiss model that is derived by a combination of other modeled signals analyzed earlier in time.

9. The system of claim 1 where the noise detector is configured to derive an average passing tire hiss model that is derived by a weighted average of other modeled signals analyzed earlier in time.

10. The system of claim 1 where the noise attenuator is configured to substantially remove the passing tire hiss and a continuous noise from the input signal.

11. The system of claim 1 further comprising a residual attenuator electrically coupled to the noise detector and the noise attenuator to dampen signal power in a mid to high frequency range when a large increase in a signal power is detected in the mid to high frequency range.

12. The system of claim 1 further including an input device electrically coupled to the noise detector, the input device configured to convert sound waves into analog signals.

13. The system of claim 1 further including a pre-processing system coupled to the noise detector, the pre-processing system configured to pre-condition the input signal before the input signal is processed by the noise detector.

14. The system of claim 13 where the pre-processing system comprises a first microphone and a second microphone spaced apart and configured to exploit a lag time of a signal that may arrive at the first microphone or the second microphone.

15. The system of claim 14 further comprising a controller that automatically selects the first microphone or the second microphone and a channel that senses the least amount of noise in the input signal.

16. The system of claim 1 where the noise detector is configured to detect occurrence of passing tire hiss in the input signal based on a correlation between the smoothly varying function and an envelope of the input signal in the time domain over one or more frequency bands of the input signal.

17. The system of claim 1 where the smoothly varying function comprises a log-Lorentzian function, with a width determined by a speed of a passing vehicle generating the passing tire hiss, and a sharpness determined by a lateral distance of the passing vehicle from a receiver that received the input signal.

18. The system of claim 1 where the noise detector is configured to separate noise-like segments of the input signal from remaining portions of the input signal, and where the noise detector is configured to analyze the noise-like segments to identify whether the noise-like segments include passing tire hiss noise.

19. The system of claim 18 where the noise detector is configured to derive a passing tire hiss model when the noise-like segments include passing tire hiss noise, where the noise detector is configured to store the passing tire hiss model in memory, and where the noise attenuator is configured to use the passing tire hiss model stored in memory to remove passing tire hiss from the input signal.

20. The system of claim 1 where the noise detector comprises a processor configured to run logic to detect the passing tire hiss from the input signal.

21. A system for detecting passing tire hiss noise from a signal, comprising:

a time frequency transform logic that converts a time varying input signal into the frequency domain;

a background noise estimator coupled to the time frequency transform logic, the background noise estimator configured to measure a continuous noise that occurs near a receiver; and a passing tire hiss noise detector coupled to the background noise estimator, the passing tire hiss noise detector configured to automatically identify and model a noise associated with passing tire hiss;

where the passing tire hiss noise detector is configured to identify whether the input signal includes the noise associated with passing tire hiss based on a correlation between a smoothly varying function and a portion of the input signal.

22. The system of claim 21 further comprising a transient detector configured to disable the background noise estimator when a transient signal is detected.

23. The system of claim 21 where the passing tire hiss noise detector is configured to identify that the noise is associated with passing tire hiss based on the correlation between the smoothly varying function and the portion of the input signal.

24. The system of claim 23 wherein the smoothly varying function is a Lorentzian function.

25. The system of claim 21 further comprising a signal discriminator coupled to the passing tire hiss noise detector, the signal discriminator configured to mark the voice and the noise segments of the input signal.

26. The system of claim 21 further comprising a passing tire hiss noise attenuator coupled to the passing tire hiss noise detector, the passing tire hiss noise attenuator configured to reduce the noise associated with the passing tire hiss that is sensed by the receiver.

27. The system of claim 26 where the noise attenuator is configured to substantially remove the noise associated with the passing tire hiss from the input signal.

28. The system of claim 21 further comprising a residual attenuator coupled to the background noise estimator operable to dampen signal power in a mid to high frequency range when a large increase in signal power is detected in the mid to high frequency range.

29. The system of claim 21 where passing tire hiss noise detector comprises a processor configured to run logic to identify the noise associated with passing tire hiss.

30. A system for suppressing passing tire hiss noise from a signal, comprising:

a time frequency transform logic that converts a time varying input signal into the frequency domain;

a background noise estimator coupled to the time frequency transform logic, the background noise estimator configured to measure a continuous noise that occurs near a receiver;

a passing tire hiss noise detector coupled to the background noise estimator, the passing tire hiss noise detector configured to fit a smoothly varying function to a portion of an input signal, where the passing tire hiss noise detector is configured to identify whether the input signal includes passing tire hiss based on a correlation between the smoothly varying function and the portion of the input signal; and a passing tire hiss noise attenuator coupled to the passing tire hiss noise detector, the passing tire hiss noise attenuator being configured to remove a noise associated with passing tire hiss that is sensed by the receiver.

31. The system of claim 30 where the passing tire hiss noise detector is configured to detect occurrence of passing tire hiss in the input signal based on a correlation between the smoothly varying function and an envelope of the input signal in the time domain over one or more frequency bands of the input signal.

32. A method of removing passing tire hiss from a signal comprising:

converting a time varying signal to a complex spectrum;

estimating a background noise;

detecting a passing tire hiss noise based on a correlation between a smoothly varying function and a portion of an input signal; and dampening the passing tire hiss noise from the input signal.

33. The method of claim 32 where the act of estimating the background noise comprises estimating the background noise when a transient is not detected.

34. The method of claim 32 where the act of dampening the passing tire hiss noise comprises substantially removing the passing tire hiss noise from the input signal.

35. The method of claim 32 where the act of detecting the passing tire hiss noise comprises detecting occurrence of the passing tire hiss noise in the input signal based on the correlation between the smoothly varying function and an envelope of the input signal in the time domain over one or more frequency bands of the input signal.

36. The method of claim 32 where the act of detecting the passing tire hiss noise comprises detecting the passing tire hiss noise by a processor configured to run logic to detect the passing tire hiss noise from the input signal.

37. A method of removing passing tire hiss from a signal comprising:

converting a time varying signal to a complex spectrum;

estimating a background noise;

detecting a passing tire hiss noise when a high correlation exists between a smoothly varying function and a portion of an input signal; and removing the passing tire hiss noise from the input signal.

38. A computer-readable non-transitory medium storing software that, when executed by a computer, causes the computer to control a detection of a noise associated with a passing tire hiss, the software comprising:

a detector logic that processes electrical signals that represent sound waves;

a spectral conversion logic that converts the electrical signals from a first domain to a second domain; and a signal analysis logic that models a portion of the sound waves that are associated with the passing tire hiss;

where the signal analysis logic identifies that the portion of the sound waves contains passing tire hiss based on a correlation between a smoothly varying function and the portion of the sound waves.

39. The computer-readable medium of claim 38 further comprising logic that derives a portion of a speech signal masked by the noise.

40. The computer-readable medium of claim 38 further comprising logic that attenuates portion of the sound waves.

41. The computer-readable medium of claim 38 further comprising attenuator logic operable to limit a power in a mid to high frequency range.

42. The computer-readable medium of claim 38 further comprising noise estimation logic that measures a continuous or ambient noise sensed by the detector.

43. The computer-readable medium of claim 42 further comprising transient logic that disables the estimation logic when an increase in power is detected.

44. The computer-readable medium of claim 38 where the signal analysis logic is coupled to a vehicle.

45. The computer-readable medium of claim 38 where the signal analysis logic is coupled to an audio system.

46. The computer-readable medium of claim 38 where the signal analysis logic models only the sound waves that are associated with the passing tire hiss.

47. A system for suppressing passing tire hiss noise from a signal, comprising:

noise detecting means for detecting and modeling a passing tire hiss from an input signal; and noise attenuating means electrically connected to the noise detecting means for attenuating at least a portion of the passing tire hiss from the input signal;

where the noise detecting means is configured to identify whether the input signal includes the passing tire hiss by a processor fitting a smoothly varying function to a portion of the input signal.

48. The system of claim 47 where the noise detecting means is configured to identify whether the input signal includes passing tire hiss by fitting a Lorentzian function to a portion of the input signal in a time domain.

49. The system of claim 47 where the noise detecting means is configured to model the passing tire hiss by fitting the smoothly varying function to the input signal in a time-frequency domain.

50. The system of claim 47 where the noise detecting means is configured to constrain a passing tire hiss adaptation when a structure similar to a vowel or a harmonic like structure is detected.

51. The system of claim 47 where the noise detecting means is configured to receive information from an automotive bus and to selectively constrain a passing tire hiss adaptation based on the information received from the automotive bus.

52. The system of claim 47 where the noise detecting means is configured to derive an average passing tire hiss model, and the average passing tire hiss model is not updated near a speech or speech plus noise signal.

53. The system of claim 47 where the noise detecting means is configured to derive an average passing tire hiss model that is derived by a combination of other modeled signals analyzed earlier in time.

54. The system of claim 47 where the noise detecting means is configured to derive an average passing tire hiss model that is derived by a weighted average of other modeled signals analyzed earlier in time.

55. The system of claim 47 where the noise attenuating means is configured to substantially dampen the passing tire hiss and a continuous noise from the input signal.

56. The system of claim 47 further comprising residual attenuating means electrically coupled to the noise detecting means and the noise attenuating means for dampening signal power in a mid to high frequency range when a large increase in a signal power is detected in the mid to high frequency range.

57. The system of claim 47 further including input means electrically coupled to the noise detecting means for converting sound waves into analog signals.

58. The system of claim 47 further including pre-processing means coupled to the noise detecting means for preconditioning the input signal before the input signal is processed by the noise detecting means.

59. The system of claim 58 where the pre-processing means comprises first and second input means spaced apart and configured to exploit a lag time of a signal that may arrive at the different input means.

60. The system of claim 59 further comprising control means for automatically selecting an input means and a channel that senses the least amount of noise in the input signal.

* * * * *